United States Patent [19]

Erickson

[11] Patent Number: 4,737,177

[45] Date of Patent: Apr. 12, 1988

[54] AIR DISTILLATION IMPROVEMENTS FOR HIGH PURITY OXYGEN

[76] Inventor: Donald C. Erickson, 1704 S. Harbor La., Annapolis, Md. 21401

[21] Appl. No.: 893,045

[22] Filed: Aug. 1, 1986

[51] Int. Cl.[4] ..... F25J 3/04

[52] U.S. Cl. ..... 62/22; 62/27; 62/34; 62/38

[58] Field of Search ..... 62/11, 22, 23, 24, 27, 62/29, 34, 36, 38, 42

[56] References Cited

U.S. PATENT DOCUMENTS

| | | | |
|---|---|---|---|
| 2,433,508 | 12/1947 | Dennis | 62/22 X |
| 2,812,645 | 11/1957 | Locklair et al. | 62/28 X |
| 2,824,428 | 2/1958 | Yendall | 62/29 X |
| 2,934,907 | 5/1960 | Scofield | 62/22 X |
| 3,079,759 | 3/1963 | Schilling | 62/22 X |
| 3,127,260 | 3/1964 | Smith | 62/22 |
| 3,210,951 | 10/1965 | Gaumer, Jr. | 62/13 X |
| 4,137,056 | 1/1979 | Golovko | 62/24 X |
| 4,410,343 | 10/1983 | Ziemer | 62/34 X |
| 4,433,989 | 2/1984 | Erickson | 62/22 X |

OTHER PUBLICATIONS

C. Judson King, "Separation Processes," McGraw-Hill Book Co., 1980, p. 221.

Streich, et al., "Production of Large Quantities of Oxygen by an Improved Two Column Process," International Congress of Refrigeration 1979, pp. 513-519.

*Primary Examiner*—Steven E. Warner

[57] ABSTRACT

The inefficiency of the nitrogen stripping section of a high purity oxygen-producing air distillation plant is reduced. This allows increased recovery of byproduct argon and in some cases increased recovery of refrigeration work also. The improvement is obtained by evaporating kettle liquid with condensing argon rectifier vapor in two sequential stages, to yield vapor streams respectively having more and less $O_2$ content than the kettle liquid, and separately feeding them to the $N_2$ removal column. The improvement is applicable to both dual and triple pressure processes. Referring to FIG. 1, kettle liquid is supplied via valve 11 to the top of contactor 18, and overhead reflux condenser 13 of argon rectifier 14 reboils the bottom of contactor 18. Vapor streams of differing $O_2$ composition are withdrawn from above and below 18.

14 Claims, 3 Drawing Sheets

AIR DISTILLATION IMPROVEMENTS FOR HIGH PURITY OXYGEN

TECHNICAL FIELD

The invention comprises process and apparatus for improved cryogenic distillation of air to produce high purity oxygen (e.g., 99.5% purity) plus crude argon byproduct. The improvement results in increased argon recovery, increased $O_2$ delivery pressure, and/or decreased energy consumption, all with simpler and more economical hardware modifications than heretofore necessary.

BACKGROUND ART

One source of efficiency loss in high purity $O_2$ plants with byproduct argon is the nitrogen stripping section of the $N_2$ removal column. The $N_2$ stripping section is above the argon stripping section and below the feed point; the withdrawal point of the crude oxygen containing argon is between the argon and $N_2$ stripping sections. In most prior art flowsheets, both conventional dual pressure and low energy triple pressure, this section has more reboil than necessary, resulting in large mixing losses and decreased argon recovery. The minimum reboil required up the $N_2$ stripping section, i.e., the amount necessary to avoid "pinching out", in the absence of an intermediate reboiler, is determined by the composition and quality of the column feed. The column feed is usually the HP rectifier liquid bottom product, conventionally known as "kettle liquid", of about 34 to 38% oxygen composition. Kettle liquid is usually evaporated at the overhead of the argon rectifying section to reflux the argon rectifier; thus, part of the $N_2$ removal column feed is fully evaporated kettle liquid, of about 34 to 38% $O_2$ composition. This establishes a minimum V/L (molar vapor flow divided by molar liquid flow) in the $N_2$ stripping section of about 0.6, corresponding to 30.6 moles of vapor ascending and 51 moles of liquid descending, all per 100 moles of air feed.

Typical operating conditions for the conventional dual pressure cryogenic high purity oxygen flowsheet with argon sidearm (rectifier) are disclosed by M. Streich and J. Dworschak in the technical article "Production of Large Quantities of Oxygen by an Improved Two-Column Process", appearing at pages 516–517 of the Proceedings of the XV International Congress of Refrigeration, 1979.

It is possible to reflux the overhead of the argon rectifier by latent heat exchange with intermediate liquid from the $N_2$ stripping section, instead of evaporating kettle liquid. This is disclosed in U.S. Pat. No. 2,316,056. If an intermediate height of the $N_2$ stripping section is selected where the vapor $O_2$ composition is appreciably greater than 34 to 38%, e.g., about 41% or higher, then the minimum V/L in the $N_2$ stripping section can be significantly decreased to 0.54 or lower (a 10% reduction) and the reboil up the argon rectifier correspondingly increased. This will increase argon recovery. However, it has the following disadvantage: in order to achieve the desired purity of the crude argon, on the order of 95%, it is necessary that the argon rectifier have substantially more theoretical stages of countercurrent vaporliquid contact, for example 40 as compared to 20 in the $N_2$ stripper. This places the argon rectifier overhead at a considerably different height than the appropriate intermediate height of the $N_2$ stripping section. Thus, regardless of whether the reflux condenser is located at the argon rectifier overhead, or the $N_2$ stripper intermediate height, or external to both columns, at least one reflux liquid pump will be required to compensate for the height difference.

U.S. Pat. No. 4,670,031 by the present applicant, which is incorporated by reference, discloses that in order to increase argon recovery it is necessary to send more reboil up the oxygen-argon rectifying section and correspondingly less reboil up the nitrogen-crude oxygen rectifying section. That application also discloses a means for both further increasing argon recovery and for avoiding the tray height disparity cited above which necessitates a pump. The disclosed means is to exchange latent heat from intermediate height argon rectifier vapor to intermediate height $N_2$ stripper liquid. Since the intermediate argon rectifier vapor is at a higher temperature than the overhead vapor, it can provide intermediate reboil to a lower (warmer) height of the $N_2$ stripper, i.e., a height corresponding to even higher $O_2$ composition. This further reduces the fraction of reboil required up the lower part of the $N_2$ stripper, and correspondingly increases the reboil possible up the lower section of the argon rectifier, thus increasing argon recovery. Also, it is possible to locate the intermediate height of the argon rectifier such that liquid return from the intermediate reboiler/intermediate reflux condenser is by gravity, avoiding the need for a pump.

The disadvantages of this configuration are that an additional heat exchanger is required; and that the reboil up the top half of the argon rectifier is low, where the relative volatility is also very low.

The same advantages from exchanging latent heat from an intermediate height of the argon rectifier to an intermediate height of the $N_2$ stripping section are also obtainable in low energy triple pressure flowsheets, as disclosed in U.S. Pat. Nos. 4,578,095 and 4,605,427.

A second source of efficiency loss in dual pressure high purity oxygen plants is the large $\Delta T$ of the argon rectifier reflux condenser, on the order of 4° to 5° C. This is the difference between crude argon condensing temperature and kettle liquid evaporating temperature.

It is known to evaporate kettle liquid at a pressure appreciably above the $N_2$ rejection column pressure, by exchanging latent heat with HP rectifier overhead vapor, and then expand the vapor to column pressure. Examples are presented in the Streich and Dworschak article cited above, and in U.S. Pat. No. 2,753,698. Since this technique results in appreciable vapor flow bypassing the argon stripper, it is not appropriate for the production of high purity oxygen.

It is also known to evaporate kettle liquid at essentially the same pressure as the $N_2$ removal column by latent heat exchange with HP rectifier vapor. This can be done via a single stage of evaporation (U.S. Pat. Nos. 4,208,199 and 4,254,629) by multiple stages of evaporation (U.S. Pat. No. 2,812,645). These flowsheets similarly are not suited for production of large quantities of high purity oxygen plus byproduct argon.

Copending application No. 853461 filed 4/18/86 by the present applicant discloses means to increase $O_2$ delivery pressure while retaining high recovery in high purity $O_2$ plants by warm companding a minor fraction of supply air to above supply pressure, totally condensing it to evaporate product oxygen, and splitting the liquid air as intermediate reflux to both the HP rectifier and $N_2$ removal column.

U.S. Pat. No. 4,072,023 discloses means for increasing $O_2$ production pressure by cold companding the gaseous $O_2$ product stream using extra expansion power not necessary for process refrigeration.

What is needed, and one objective of this invention, is to achieve increased argon recovery in a high purity $O_2$ flowsheet without incurring at least some of the disadvantages present in prior art flowsheets: need for pumping reflux liquid uphill, need to provide an additional heat exchanger, or need to reduce reboil in top half of the argon rectifier. A further objective is to recover useful energy in place of the inefficient large $\Delta T$ heat exchange occurring in conventional argon rectifier reflux condensers. A most preferred solution would satisfy both of these objectives (solve both problems) simultaneously.

DISCLOSURE OF INVENTION

The essential point of novelty of all embodiments of the disclosed invention is that the latent heat exchange between argon rectifier vapor and kettle liquid be conducted in such a manner that two separate vapor streams are generated: one having substantially higher $O_2$ content than the kettle liquid, and the other substantially lower. Furthermore, each vapor stream is injected separately to different heights of the $N_2$ removal column, whereby the required reboil up the bottom section of the $N_2$ stripping section is reduced to below about 25 m/m (moles per 100 moles of compressed air), and preferably below 20 m/m.

Under this generic disclosed method of increasing argon recovery in high purity $O_2$ plants, there are two specific embodiments, one requiring only a single reflux condenser for the argon rectifier, and the other requiring two. In the one heat exchanger embodiment, the kettle liquid evaporator incorporates at least one stage of countercurrent vapor liquid contact above the latent heat exchanger. Kettle liquid is supplied at the overhead, and vapor is withdrawn from both above and below the stage(s) of countercurrent contact. The higher vapor has $O_2$ content less than kettle liquid composition, and the lower vapor stream has $O_2$ content greater than kettle liquid composition.

In the two heat exchanger embodiment, once again the kettle liquid evaporates in two sequential stages, but in this embodiment there is a separate heat exchanger for each stage. Although it is disadvantageous to require a second heat exchanger, important offsetting advantages are obtained due to one of the exchangers being located at a relatively warmer intermediate height of the argon rectifier. The advantages are detailed below.

In summary, process and apparatus are provided for producing high purity oxygen by cryogenic distillation of air comprising:

(a) rectifying at least part of the pressurized supply air to kettle liquid and liquid $N_2$;

(b) providing an argon rectifier and a nitrogen removal column incorporating a nitrogen stripping section;

(c) refluxing the argon rectifier and producing two vapor streams having differing $O_2$ contents, one at least 3% more than that of kettle liquid and the other at least 3% less, by exchanging latent heat from argon rectifier vapor to at least partially depressurized kettle liquid; and d) separately feeding each vapor stream to different heights of said $N_2$ stripping section.

BEST MODE FOR CARRYING OUT THE INVENTION

Figure 1:
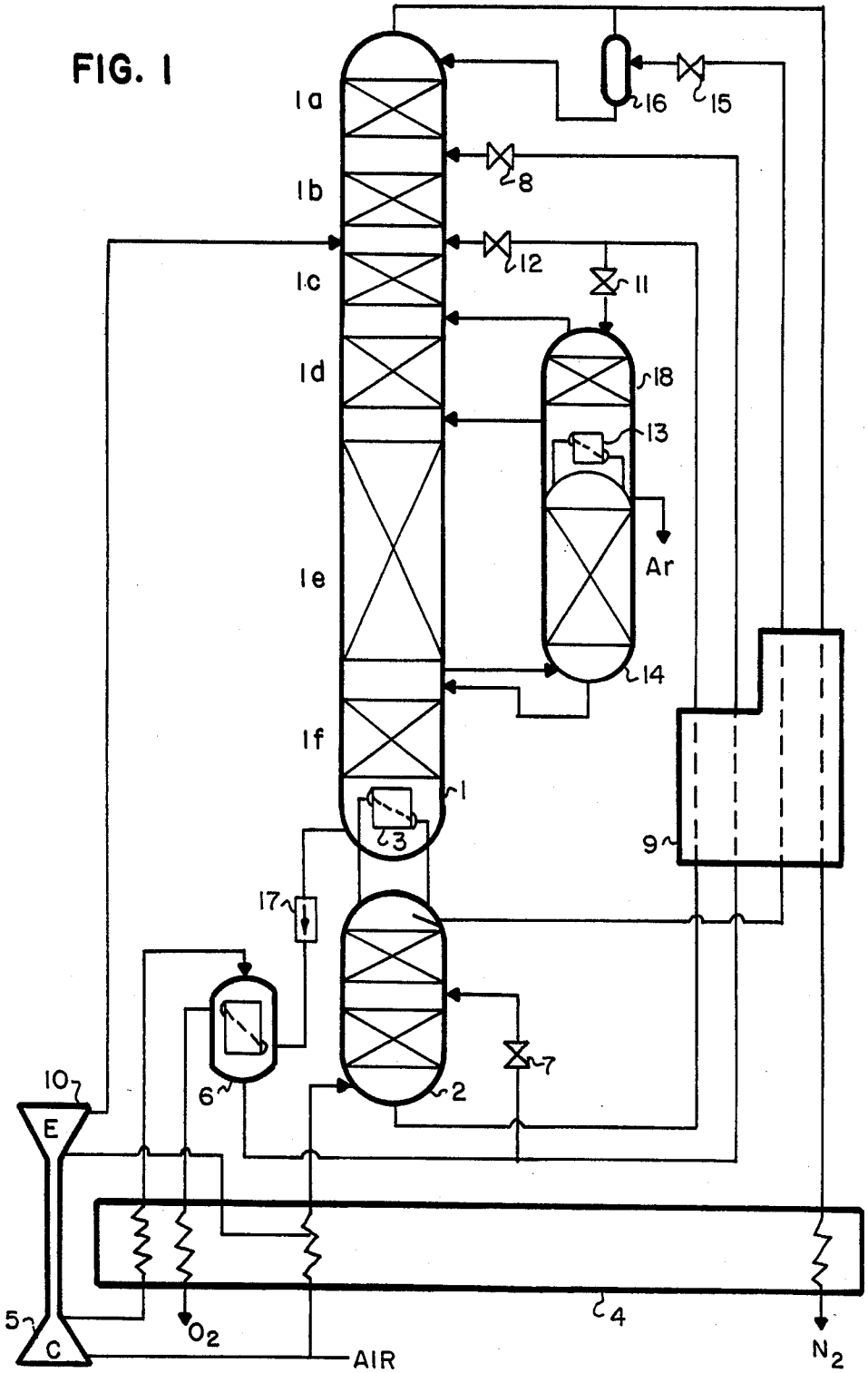
FIG. 1 is a simplified schematic flowsheet of the embodiment of the invention wherein only a single heat exchanger is used to reflux the argon rectifier, as on conventional dual pressure plants, but increased argon recovery is achieved.

Referring to FIG. 1, nitrogen removal column 1 is comprised of argon stripping section 1*f*, nitrogen stripping sectione 1*e* (lower), 1*d*, and 1*c*, and nitrogen rectification sections 1*b* and 1*a*. High pressure rectifier 2 exchanges latent heat with column 1 via bottoms reboiler-/overhead reflux condenser 3. Rectifier 2 is supplied compressed air via main exchanger 4. The air may be dried and cleaned by any known technique: molecular sieve, regenerators, reversing exchangers, caustic wash, and the like. Process refrigeration may be provided in any known manner, for example by expanding part (about 13 m/m) of the supply air in expander 10 to column 1 pressure. Product quality liquid oxygen may be evaporated to product oxygen by any known manner, although the preferred manner is to warm compress a minor fraction (about 30 m/m) of the supply air in compressor 5 powered by expander 10, and evaporate liquid oxygen which has been hydrostatically compressed (i.e., by a barometric leg) in LOX evaporator 6. The air totally condenses, and then is split by coordinated action of valves 7 and 8 to become intermediate reflux for both HP rectifier 2 and $N_2$ removal column 1. Component 17 prevents reverse flow of oxygen liquid or vapor, and may also incorporate a hydrocarbon adsorbing medium. Heat exchanger 9 exchanges sensible heat between column 1 overhead vapor and the various liquid streams en route to column 1: liquid $N_2$ via valve 15 and phase separator 16; liquid air via valve 8; and kettle liquid to valves 11 and 12. Valve 12 allows the optional introduction of part of the kettle liquid directly to column 1 as liquid; the remainder to valve 11 is evaporated to two vapor streams of differing $O_2$ content, one at least 3% more $O_2$ than the kettle liquid and the other at least 3% less, and then those streams are separately fed to the $N_2$ stripping sections of column 1. The two vapor streams of differing $O_2$ content are produced as follows. Argon rectifier 14, which in FIG. 1 is a sidearm of column 1, i.e., its bottom is in both vapor and liquid communication with the crude oxygen intermediate height of column 1, is refluxed by reflux condenser 13. Associated with the evaporating side of condenser 13 is a zone of countercurrent vapor-liquid contact 18. This may be a single seive tray bubble cap tray, short section of random or structured packing, or the like. Kettle liquid from valve 11 is supplied to the top of contactor 18 at approximately column 1 pressure. Condenser 13 functions to reboil contactor 18, thus providing two vapor streams of differing $O_2$ content: one withdrawn from below the contactor, and the other from above. Crude argon of about 95% purity is withdrawn from the overhead of rectifier 14, either as vapor or liquid. Since the higher $O_2$ content stream has more $O_2$ than kettle liquid, it is introduced to a warmer column 1 location than would be used for vapor of kettle liquid composition. This allows the reboil rate through section 1*e* of the $N_2$ stripper to be reduced below 30 m/m, for example to the range of 20 to 25 m/m, and hence argon recovery is increased to about 70% or more.

Figure 2:
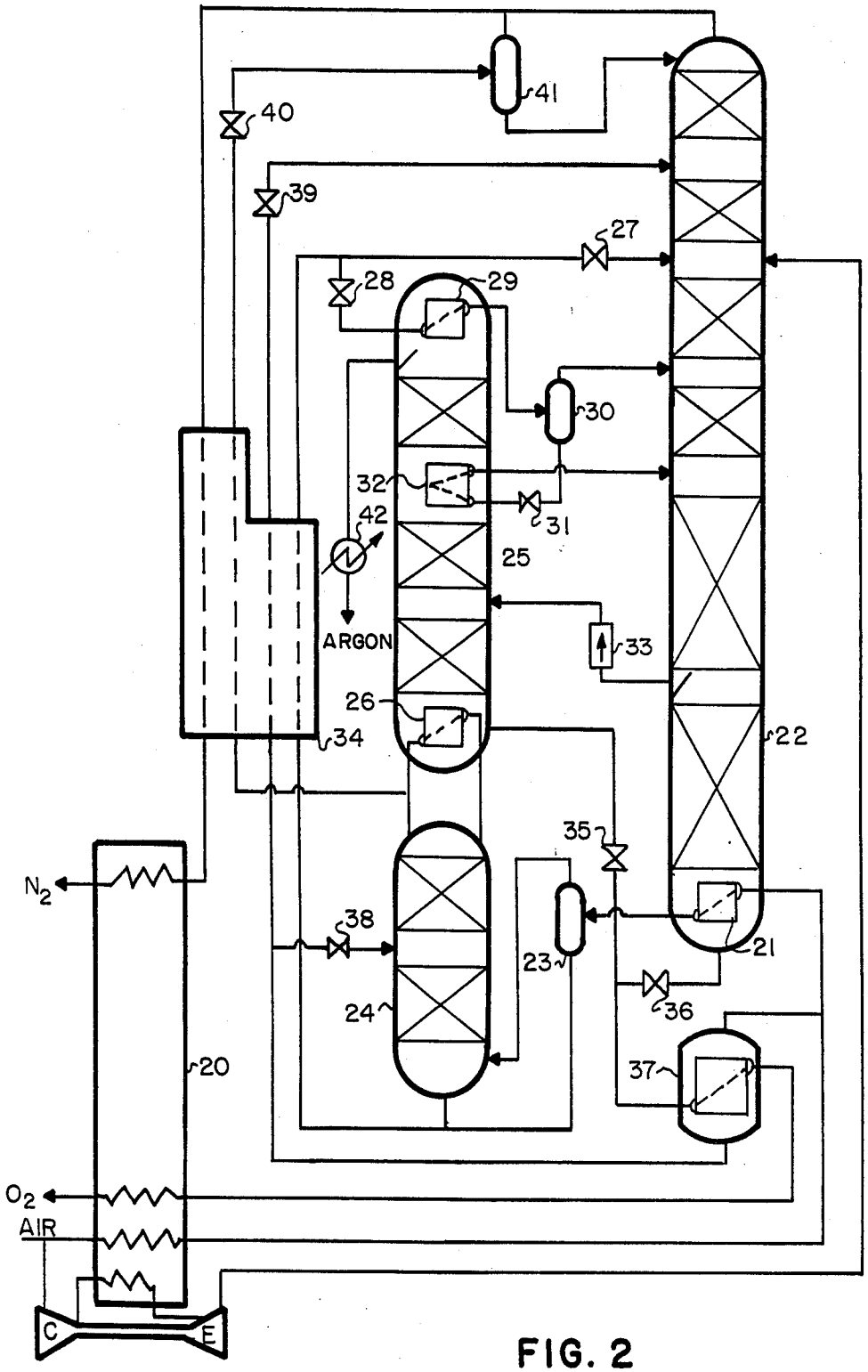
FIG. 2 illustrates the embodiment wherein two separate heat exchanges are used, to transfer latent heat from argon rectifier vapor to kettle liquid, as applied to a triple pressure flowsheet.

In FIG. 2, the embodiment of the disclosed invention pertaining to low energy triple pressure flowsheets, air is compressed and cleaned as before and cooled to near its dewpoint in main exchanger 20. At least a majority of the supply air passes through reboiler 21 wherein a minor fraction partially condenses so as to provide bottoms reboil to $N_2$ removal column 22. The liquid fraction may be separated at phase separator 23 and combined with kettle liquid from HP rectifier 24, while the vapor fraction is fed to rectifier 24. Rectifier 24, is refluxed by exchanging latent heat with oxygen-argon distillation column 25 in reboiler/reflux condenser 26. Part of the kettle liquid may be directly fed to column 22 as liquid via valve 27, and the remainder is supplied via valve 28 to overhead reflux condenser 29 of column 25. The kettle liquid is partially evaporated in 29 to a vapor stream having lower $O_2$ content and a liquid stream having higher $O_2$ content. The vapor is separated from the liquid in phase separator 30 and fed directly to column 22; the liquid is routed via valve 31 to intermediate reflux condenser 32 where it is essentially totally evaporated to a vapor stream having higher $O_2$ content than kettle liquid, which stream is fed to column 22 at a lower height. The vapor stream from condenser 32 can thus be at about the same temperature or even warmer than column 25 overhead temperature, which is not possible for the vapor from condenser 29. Once again vapor feed is provided to column 22 at a lower height than allowed by conventional practice, enabling lower reboil rates up the bottom part of the $N_2$ stripping section of that column. Liquid feed for column 25 is withdrawn from column 22 preferably at an intermediate height between the $N_2$ stripping section and the argon stripping section, although bottom withdrawal is also possible. Column 22 pressure is slightly higher than column 25 pressure, e.g., 1.3 ATA compared to 1.0 ATA, so liquid transfer does not require a pump for reasonably matched heights. Thus, optional component 33 may simply serve to prevent reverse flow and to adsorb hydrocarbons. Fluid streams to and from column 22 exchange sensible heat in exchanger 34. Product quality liquid oxygen in the bottom of column 25 (and preferably also column 22) may be evaporated in any known manner. The preferred method, however, is to combine the liquid streams via valves 35 and 36 and route them to LOX evaporator 37, in which a minor fraction of the supply air is essentially totally condensed. Thus oxygen is evaporated at a higher pressure than column 25 bottom pressure. Then the liquid air is split into two intermediate reflux streams for rectifier 24 and column 22 by action of valves 38 and 39 respectively. This makes high $O_2$ recovery possible. Reflux liquid nitrogen for column 22 is depressurized at valve 40 and separated from flash vapor at phase separator 41. Crude argon is preferably withdrawn from column 25 overhead as liquid, hydrostatically compressed to above atmospheric pressure, and then evaporated at 42 (or stored as liquid). Process refrigeration may be supplied by any known technique. One preferred approach is to expand in work expander 43 a minor fraction of partially cooled supply air to column 22 pressure and feed it thereto as vapor. Even more preferred is to first provide additional warm compression to the fraction to be expanded in warm compressor 44 which is directly powered by expander 43. The compander does not cost appreciably more than expander 43 alone, and reduces the required refrigeration flow rate by about 25%, to about 10 to 12 m/m. This is important for retaining high $O_2$ recovery from triple pressure TC LOXBOIL flowsheets, as is the liquid air split.

Overall the FIG. 2 flowsheet retains high recovery of $O_2$ and argon, requires no liquid pumps, allows lesser overall column height, and saves about 12% compression power, compared to a conventional dual pressure high purity $O_2$ process with similar production. Condenser 32 will preferably be about 2 to 3K warmer than condenser 29.

The two-exchanger configuration (29 and 32) illustrated by FIG. 2 for converting kettle liquid to two vapor streams of differing $O_2$ content also applies to dual pressure flowsheets. This can be done as shown in FIG. 2, i.e., the kettle liquid is initially supplied to the argon rectifier overhead reflux condenser, and then the unevaporated liquid supplied to the intermediate reflux condenser. This has the advantage that the high $O_2$ content vapor can have very high $O_2$ content, on the order of 50% or more, because of the higher temperature at the argon rectifier intermediate height. Thus reboil up the lower section of the $N_2$ stripping section can be greatly reduced, e.g., to as low as about 15 m/m. This further increases argon recovery. Alternatively the two reflux condenser embodiment may be used to achieve a different objective—-maximum recovery of expansion work. That alternative embodiment is illustrated in FIG. 3.

Figure 3:
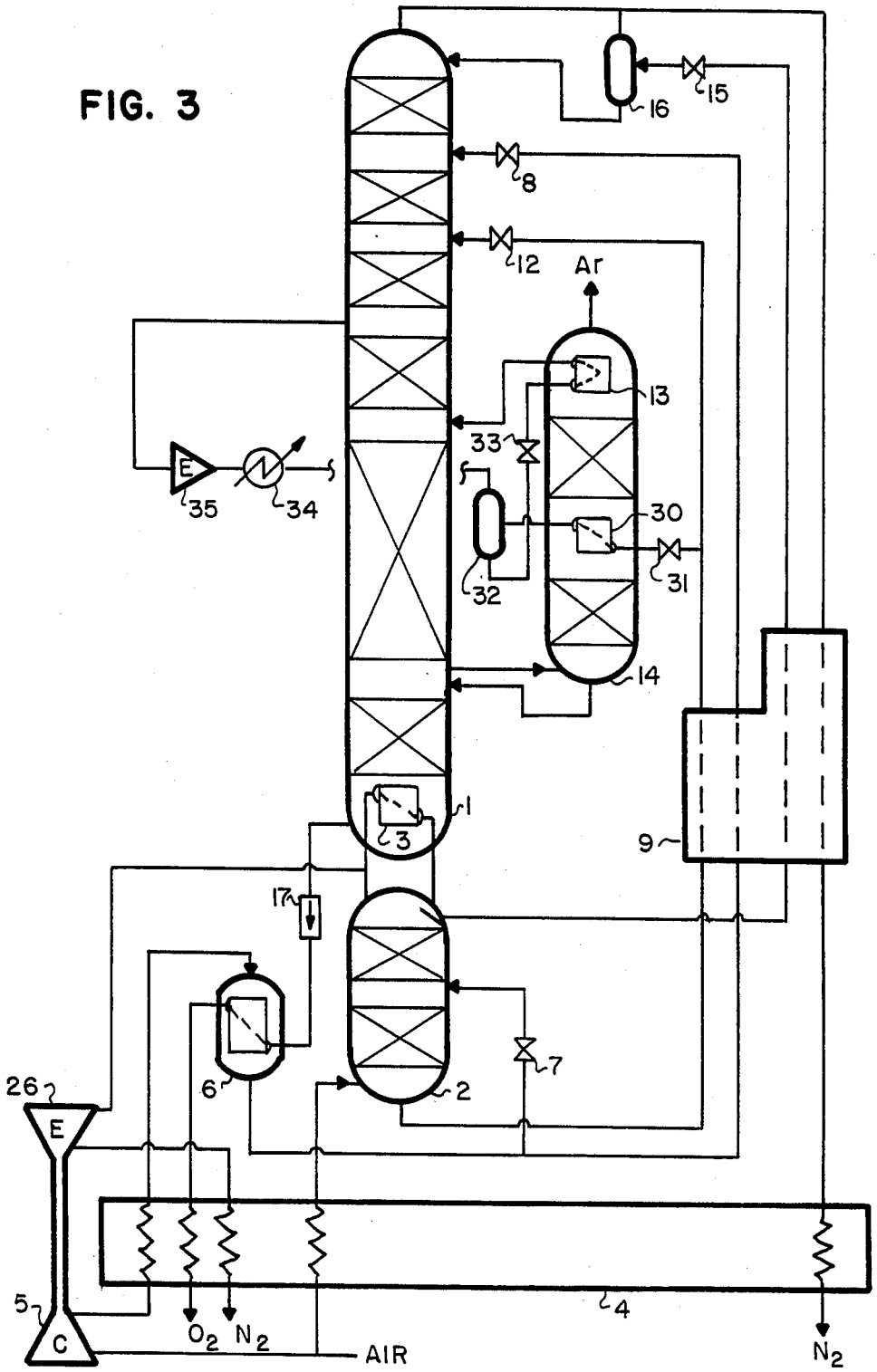
FIG. 3 illustrates the two-heat-exchanger embodiment as applied to a dual pressure flowsheet so as to allow maximum recovery of expansion work.

In FIG. 3, components 1 to 9 and 12 to 17 have descriptions similar to those presented for FIG. 1. The essential difference between the two flowsheets is the addition of intermediate reflux condenser 30 in argon rectifier 14, which is supplied at least part of the kettle liquid via valve 31. The partially evaporated kettle liquid is phase separated at 32. Partial evaporation occurs at a pressure at least 1.5 times the column 1 pressure. The vapor fraction from 32 is then work-expanded in 35 after being sensibly heated sufficiently in 34 to ensure against condensation, and the expanded vapor is fed to column 1. The unevaporated liquid from separator 32 is depressurized to about column 1 pressure by valve 33, to serve as the source of latent heat cooling to overhead reflux condenser 13, being essentially totally evaporated thereby, and then fed to column 1. The heat source for exchanger 34 may be any convenient process fluid stream, for example the liquid supply to valve 8 or a passage in exchanger 4. As with FIG. 1, the process refrigeration and the evaporation of the oxygen product may be accomplished in any known manner. FIG. 3 illustrates refrigeration by expansion of HP rectifier overhead vapor in 26, and companded total condensation LOXBOIL with liquid air split.

As illustrated by FIGS. 2 and 3, the two-heat-exchanger embodiment of this invention can assume either of two forms depending on the primary objective. If the objective is to maximize the increase in argon recovery, the kettle liquid is routed to the overhead reflux condenser first, and both reflux condensers operate at about the same pressure. If the objective is to increase the refrigeration work obtained, coupled with only a lesser increase in argon recovery, then kettle liquid is routed first to the intermediate reflux condenser, and it generates vapor at a substantially higher pressure than does the overhead reflux condenser.

The work from the extra expansion of cold vapor can be put to a variety of useful purposes. It can be used to further increase the $O_2$ production pressure, by either cold companding the gaseous oxygen itself or the air which boils the liquid oxygen. It can be used directly as refrigeration, thereby allowing more withdrawal of liquid byproducts, or reducing the required flow to the primary expander, thus allowing more recovery of gaseous byproducts such as high pressure $N_2$. Also, it can be used to drive a cold open cycle heat pump which increases reboil through the argon rectifier, thus further increasing argon recovery. The refrigeration recoverable from partial expansion of partially evaporated kettle liquid amounts to 30 to 40% of the overall refrigeration requirement. It will be recognized also that both the one-exchanger embodiment with contactor and the two-exchanger embodiment can be combined in the same process.

Whereas the disclosed improvement to high purity oxygen production has been disclosed in very specific environments, it will be recognized to be generally applicable to any high purity $O_2$ (>98% purity) process incorporating a separate argon rectifier. For example, various other column arrangements, reboil arrangements, reflux arrangements, LOXBOIL arrangements, and sensible heat exchange arrangements are possible. Liquid depressurization may be by devices other than valves. Provisions may be present for trace product withdrawal, such as Kr, Xe, Ne and He. The intended scope of the invention is only to be limited by the claims.

I claim:

1. Process for producing high purity oxygen by cryogenic distillation of air comprising:

(a) rectifying at least part of the pressurized supply air to kettle liquid and nitrogen;

(b) providing an argon rectifier and a nitrogen removal column incorporating a nitrogen stripping section;

(c) refluxing the argon rectifier and producing two vapor streams having differing $O_2$ contents, one at least 3% more than that of kettle liquid and the other at least 3% less, by exchanging latent heat from argon rectifier vapor to at least partially depressurized kettle liquid; and (d) separately feeding each vapor stream to different heights of said nitrogen removal column

2. Process according to claim 1 further comprising operating the section of the nitrogen stripper below the feedpoint of said vapor with higher $O_2$ content at a reboil rate of less than 25 moles reboil per 100 moles compressed air, and at a vapor/liquid ratio of less than 0.54.

3. Process according to claim 1 further comprising evaporating product oxygen by exchanging latent heat with a minor fraction of the supply air; and splitting the resulting liquid air for use as intermediate reflux to both the HP rectifier and the nitrogen removal column.

4. Process according to claim 1 further comprising feeding depressurized kettle liquid to the top of a countercurrent contactor; reboiling said contactor by said argon rectifier latent heat exchanger; and obtaining said vapor streams of differing $O_2$ content from above and below said contactor.

5. Process according to claim 4 further comprising feeding vapor withdrawn from the nitrogen removal column below the nitrogen stripping section to the argon rectifier bottom, and reboiling the nitrogen removal column bottom by exchanging latent heat with HP rectifier overhead vapor.

6. Process according to claim 1 further comprising providing two separate reflux condensers for the argon rectifier; routing kettle liquid to the first and partially evaporating it, thereby producing said vapor stream with low $O_2$ content; and routing the resulting unevaporated liquid to the second reflux condenser thereby forming the vapor stream with high $O_2$ content.

7. Process according to claim 6 further comprising producing the vapor stream at a pressure of at least 1.5 times the $N_2$ removal column pressure; and work-expanding said stream prior to feeding it to said column.

8. Process according to claim 6 further comprising locating said first reflux condenser at an intermediate height of said argon rectifier; locating said second reflux condenser at the overhead of said argon rectifier; partially evaporating kettle liquid in said first reflux condenser at a pressure substantially higher than said $N_2$ removal column pressure; and work expanding said partially evaporated kettle liquid to the approximate $N_2$ removal column pressure before said feeding thereto.

9. Process according to claim 8 further comprising feeding vapor withdrawn from below said $N_2$ stripping section to the bottom of said argon rectifier; returning liquid from said argon rectifier bottom to said $N_2$ removal column; and reboiling the $N_2$ removal column bottom by exchanging latent heat with HP rectifier overhead vapor.

10. Process according the claim 6 further comprising locating said first reflux condenser at the overhead of said argon rectifier; locating said second reflux condenser at an intermediate height of said argon rectifier; and evaporating vapor in both of said reflux condensers at the approximate pressure of the $N_2$ removal column.

11. Process according to claim 7 further comprising providing a separate column which contains both said argon rectifier and an argon stripper; withdrawing crude oxygen liquid from said $N_2$ removal column from a height below said $N_2$ stripping section; feeding said crude oxygen liquid to said separate column; withdrawing crude argon from the overhead of said argon rectifier; reboiling the bottom of said separate column by exchanging latent heat with HP rectifier overhead vapor; and reboiling the bottom of said $N_2$ removal column by exchanging latent heat with partially condensing supply air.

12. Process according to claim 11 further comprising evaporating product oxygen by exchanging latent heat with a minor fraction of the supply air which totally condenses thereby; and splitting the resulting liquid air into separate intermediate reflux streams for both said HP rectifier and said $N_2$ removal column.

13. Air distillation apparatus comprised of:

(a) high pressure rectifier for rectifying at least part of pressurized supply air to kettle liquid and nitrogen ($N_2$);

(b) $N_2$ removal column;

(c) argon rectifier including reflux condenser;

(d) a zone of countercurrent vapor-liquid contact which is reboiled by said reflux condenser;

(e) conduit for transporting at least part of the HP rectifier bottom liquid to the top of said countercurrent contact zone; and (f) separate conduits for transporting vapor from above and below said zone of countercurrent contact to the $N_2$ removal column.

14. Apparatus according to claim 13 further comprised of:

(a) vapor and liquid conduits which permit crude oxygen to communicate between bottom of argon rectifier and intermediate height of $N_2$ removal column; and (b) means for feeding a remaining part of the HP rectifier bottom liquid directly to the $N_2$ removal column as liquid.

* * * * *